United States Patent [19]

Treeby

[11] Patent Number: 4,912,687

[45] Date of Patent: Mar. 27, 1990

[54] TIME OF TIP-OVER INDICATOR

[75] Inventor: Colin H. Treeby, Admire, Kans.

[73] Assignee: Eagle River Industries, Inc., Admire, Kans.

[21] Appl. No.: 262,699

[22] Filed: Oct. 26, 1988

[51] Int. Cl.[4] ..... G04B 47/00

[52] U.S. Cl. ..... 368/10; 368/107; 220/1 T

[58] Field of Search ..... 368/1, 10, 107–113; 220/1 T

[56] References Cited

U.S. PATENT DOCUMENTS

| | | | |
|---|---|---|---|
| 631,034 | 8/1899 | Bielitz | 368/1 |
| 1,283,789 | 11/1918 | Johnson . | |
| 3,344,408 | 9/1967 | Singer et al. . | |
| 3,372,379 | 3/1968 | Collum et al. . | |
| 3,717,991 | 2/1973 | Klar | 368/1 |
| 3,845,883 | 11/1974 | Johnson et al. | 368/1 |
| 3,934,123 | 1/1976 | Maurer et al. . | |
| 4,135,067 | 1/1979 | Bitko . | |
| 4,262,842 | 4/1981 | Grover, Jr. et al. | 368/10 |
| 4,488,148 | 12/1984 | Kuciera . | |
| 4,513,183 | 4/1985 | Hill . | |
| 4,534,045 | 8/1985 | Collier . | |
| 4,545,062 | 10/1985 | Pray . | |
| 4,603,791 | 8/1986 | Spierer et al. . | |
| 4,689,757 | 8/1987 | Downing et al. . | |
| 4,860,267 | 8/1989 | Herrington et al. | 368/10 |

FOREIGN PATENT DOCUMENTS

| | | | |
|---|---|---|---|
| 355617 | 8/1931 | United Kingdom | 368/1 |

*Primary Examiner*—Bernard Roskoski

*Attorney, Agent, or Firm*—Litman, McMahon & Brown

[57] ABSTRACT

A time of top-over indicator includes a mercury tilt switch connecting a battery to a digital clock with a clock display. The assembly is positioned on structure subject to tilting, such as a refuse container emptied by tilting. When a change of switch state occurs because of tilting of the tilt switch, the clock causes the display to change in such a manner as to indicate the time of occurrence of the tilting operation. In a preferred embodiment, the clock updates the display to show the time of occurrence of the tilting of the container and so maintains the display until the next occurrence of tilting. Alternatively, the clock is reset and restarted in response to the tilting of the container and displays the elapsed time since tilting of the container occurred.

6 Claims, 1 Drawing Sheet

Fig. 1.
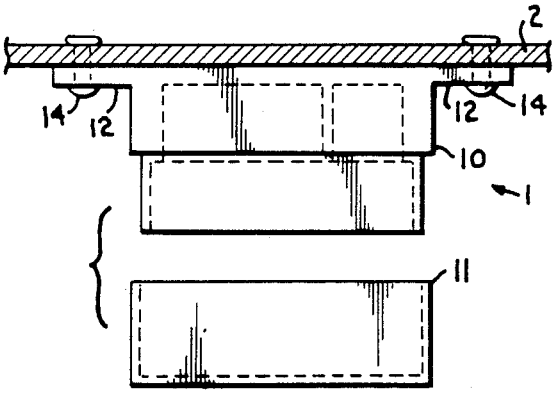
Fig. 2.
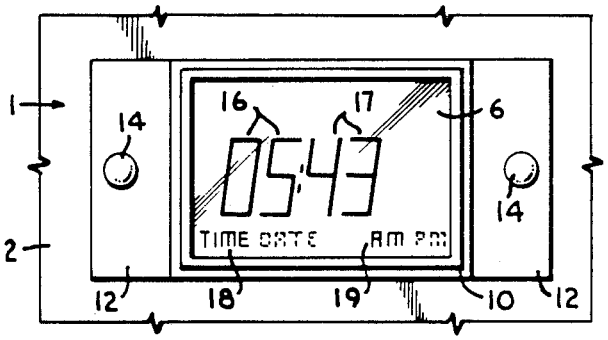
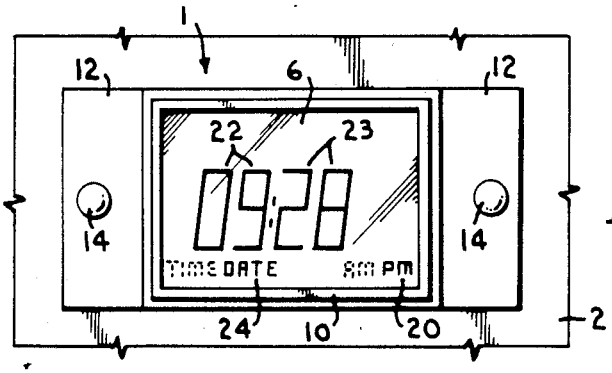
Fig. 3.
Fig. 4.
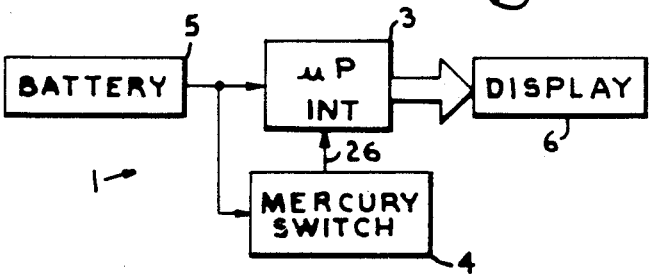
Fig. 5.
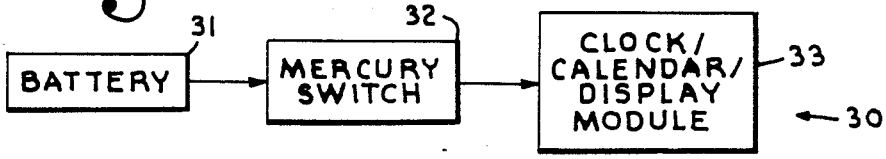

TIME OF TIP-OVER INDICATOR

FIELD OF THE INVENTION

The present invention relates to methods and apparatus for time keeping and indicating and, more particularly, to methods and apparatus for indicating the time of the emptying of a refuse container.

BACKGROUND OF THE INVENTION

There are times when it is desirable to detect the times of occurrence of certain actions. Commercial trash haulers sometimes receive complaints from customers that their refuse containers have not been emptied according to their agreed schedules. The trash hauling companies usually require their drivers to keep records of the service calls they make for various business purposes, including documentation that the required calls to customers on a route have been made. The driver may keep such records by manually filling in an activity log, punching pertinent information into a computerized logging device, or the like.

Unforeseeable events may prevent a driver from servicing a customer at a given time, such as traffic tie ups, mechanical breakdown of equipment, inclement weather, or the intervention of holidays. Other, less innocent, factors may also interfere with the process. For example, a customer may have had his container emptied on schedule, only to be refilled by someone other than the rightful 30 customer and without the customer's knowledge. In other cases, a customer may try to obtain more frequent service than contracted for by refilling his timely emptied container and then claiming that it was not emptied on schedule. Finally, an unconscientious driver may log-in service calls not actually made, out of laziness, dishonesty, or some other motive.

In order to avoid impugning the honesty of a customer or a driver without objective documentation of service rendered or proof of cheating, the trash hauling company often has no choice but to send a truck on a special trip to empty the customer's container at a non-scheduled time. Such special trips increase operating costs which must be born by other customers or the company. However, the effort required to investigate and prove that someone is cheating in the transaction also has its costs. What is needed is a mechanism for objectively indicating when a particular refuse container was emptied which does not rely on the honesty of a customer or a driver. Such a mechanism must be simple and economical, rugged enough to survive extremes of its operating environment, and tamperproof.

SUMMARY OF THE INVENTION

The present invention provides a time of tip-over indicator which may be attached to a refuse container to indicate the time and date when the container was last tilted for emptying. The indicator unit has a mercury switch which is so positioned that a switch state transition occurs when the refuse container is tilted for emptying. The mercury switch is connected between a battery and a digital clock having a numeric display connected thereto. The change of switch state of the mercury switch is detected by the digital clock which causes the display to be updated in a selected manner to indicate the time of occurrence of the tilting of the refuse container.

In a preferred embodiment of the invention, the clock display is updated to the time of day when the tilting occurred. This display is maintained until a subsequent tilting occurs. In an alternative embodiment, the clock is reset and restarted in response to the tilting of the refuse container. The clock always restarts to a given time and date, such as 12:00 midnight on January 1. On the alternative display, the numerals are concurrently updated such that the amount of time since the last tilting of the refuse container can be discerned. In each embodiment, month and date numerals are preferably alternated with hour and minute numerals such that no external switch is required to determine the date that dumping of the container ocurred.

The time of tip-over indicater unit is housed in a sealed enclosure to prevent tampering with the indicated time and date. A removable front cover is provided to protect the display device from impact damage. The clock circuitry includes a crystal controlled time base generator for accuracy. The components of the circuitry, including the battery and liquid crystal display device, are components which will operate within desired tolerances in the extremes of temperature, humidity, and mechanical shock to which the unit might be subjected. The case of the unit is irremovably attached to a refuse container, as by rivets, to prevent alteration of the indicated time and date.

OBJECTS OF THE INVENTION

The principal objects of the present invention are: to provide a system for detecting and indicating the time of occurrence of the operation of a switch; to provide such a system which generally maintains a time of day clock and which updates a clock display in a particular manner when the switch is operated; to provide such a system for detecting and indicating a time of occurrence of a tilting operation by the use of a tilt switch; to provide such a system, particularly, for objectively detecting and indicating the time of occurrence of the emptying of a refuse container which is emptied by tilting; to provide such a system including a mercury tilt switch connecting a battery to a digital clock which maintains the display of numerals representing the time of day of the latest occurrence of a change of switch state of the mercury switch; to provide a preferred embodiment of such a system wherein the digital clock is implemented as a microprocessor executing a program to function as a digital clock; to provide such a system which is capable of operating with adequate precision in an outdoor environment during all seasons and which is not vulnerable to mechanical shocks; to provide such a system which is virtually tamperproof; to provide an alternative embodiment of such a system including a mercury switch connecting a battery to a digital clock which, upon being tilted, causes resetting and restarting of the clock to indicate the amount of time which has elapsed since the tilting occurred; and to provide such a system which is economical to manufacture, durable and precise in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a top plan view of a time of tip-over indicator embodying the present invention with a front cover shown separated.

FIG. 2 is a front elevational view of the time of tip-over indicator with the front cover removed and illustrating numerals representing a time of day.

FIG. 3 is a view similar to FIG. 2 and illustrates numerals representing a month and date.

FIG. 4 is a simplified block diagram of a preferred embodiment of the time of tip-over indicator according to the present invention in which the display is only updated when a tilting operation occurs.

FIG. 5 is a simplified block diagram of an alternative embodiment of the time of tip-over indicator according to the present invention in which a tilting operation causes a resetting and restarting of the clock.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a time of tip-over indicator unit embodying the present invention. The unit 1 is illustrated attached to a structure 2 which is subject to tilting, such as a refuse container. Referring to FIG. 4, the unit 1 generally includes clock circuitry 3 operating as a digital clock, a tilt switch or mercury switch 4, a battery 5, and a digital clock display 6. Whenever the structure 2 is tilted through certain orientations, the switch state of the tilt switch 4 is changed, and the change of switch state is detected by the clock circuitry 3 which causes an alteration of the clock display 6 in such a manner as to indicate the time of occurrence of the tilting operation.

The unit 1 is housed within a case 10 which seals its circuitry from humidity and prevents tampering with the indicated time. The case 10 is preferably formed of a high impact and durable plastic which does not deteriorate from exposure to sun, rain, ice, and excursions of temperature. A removable front cover 11 is provided to protect the display device 6. The cover 11 may be removed to read the time and date indicated on the display 6. The circuitry 3, mercury switch 4, battery 5, and display 6 are all positioned within the case 10 in such a manner that they cannot be removed without indicating that tampering has occurred. However, provisions may be made for periodically replacing the battery 5 by the manufacturer. The illustrated case 1O includes side flanges 12 or similar formations through which fasteners, such as rivets 14, pass for attachment of the unit 1 to the structure 2.

Referring to FIG. 3, a preferred embodiment of the unit 1 includes the clock circuitry 3 which maintains a internal time count, proportions the time count to hours and minutes of the time of day along with the month and date. The circuitry 3 causes the display of indicia representing the time and date, such as numerals, to be displayed on the display device 6. The illustrated display device 6 is preferably a liquid crystal display device. FIG. 2 illustrates hour numerals 16 and minute numerals 17 along with a time designation 18 and "a.m." and "p.m." indicators 19 and 20 and displays the time 5:43 a.m. In FIG. 3, month numerals 22 and day of month or date numerals 23 are displayed along with a "date" designation 24 and displays the date of September 2B. Typically, the time display shown in FIG. 2 is alternated with the date display shown in FIG. 3. This simplifies the unit 1 by avoiding the necessity of a selection switch to select the time or date. In FIGS. 2 and 3, the indicia shown in phantom represent nonactivated portions of the display device 6.

The tilt switch 4 is preferably a mercury switch which is mounted in the case 10 in such a manner that when the display device 6 is in a vertical plane and oriented for reading left to right (as shown in FIGS. 2 and 3), the tilt switch 4 is in a first switch state. The unit 1 is affixed to the structure 2 in such a manner that the tilt switch 4 is normally in the first switch state. When the structure 2 is tilted from a normal first orientation to a second orientation, the tilt switch 4 assumes a second switch state complementary to the first switch state. When the structure 2 is tilted back to the original first orientation, the transition of the tilt switch 4 from the second switch state to the first switch state is detected by the clock circuitry 3. The clock circuitry 3 responds to this transition by lS causing the updating of the time and date displayed on the display device 6 to the time and date when the transition occurred. The updated time and date remain on the display device 6 until the next occurrence of the switch state transition. The first switch state may be an open state or a closed state, depending on the electrical polarity requirements of the clock circuitry 3, and the second switch state is the opposite state.

The clock circuitry 3 may be a specialized clock/calendar circuit or chip which maintains the time of day and date internally and only updates the display upon detecting a selected voltage transition. The illustrated clock circuitry 3 is a microprocessor which is mask programmed to perform timekeeping and display updating functions. The microprocessor 3 is powered by the battery 5 and has an interrupt terminal 26 which is connected to the battery 5 through the tilt switch 4. The microprocessor 3 is similar to many conventional types of microcontrollers and has an internal crystal controlled time base generator outputting a timed pulse train which increments an internal counter. Registers within the microprocessor 3 store values representing both the internal and displayed hours, minutes, month, and date. Additional registers store flags to control the a.m. and p.m. indicators 19 and 20 and the time and date designators 18 and 24.

The correct time and date are set by the manufacturer, and thereafter the unit keeps time internally. A time count from the internal counter is proportioned into minutes, hours, date, and month; and the registers storing data representing these variables are appropriately updated as the time count proceeds. The time count is also proportioned in such a manner as to time the alternation of the time and date displays. When the second to first switch state transition occurs, the voltage transition on the interrupt line 26 causes the microprocessor 3 to copy the contents of the registers storing the internal values of the minutes, hours, date, and month to the respective display registers for these values. These values are then written to the display device 6. In the meantime, the microprocessor 3 continues its internal timekeeping functions.

The microprocessor 3 is preferably implemented using a low power consumption solid state technology, such as low power complementary symmetry metal oxide semiconductor (CMOS) technology. This in combination with the inherent low power consumption of the liquid crystal display device 6 provides for very low power drain from the battery 5. The battery 5 is preferably a lithium battery which, in some low power applications, has a useful life in excess of five years and, in some cases, as long ten years. Thus, it is possible in practice that the battery 5 will never have to be replaced. It is also possible that the cost of labor and shipping involved in having the battery replaced by the manufacturer will not be significantly less than the cost of simply replacing the unit 1 with a new one, particularly if the units 1 are bought in quantity.

The structure 2 which is subject to tilting has been identified as a refuse container which is emptied by tilting. The unit 1 may also have application in indicating the time of occurrence of other types of actions. For example, in security applications the unit 1 may be used to indicate the last time of occurrence of the turning of a door knob or gate latch, the actual opening of a door, or similar types of actions. The date and time of occurrence function of the unit 1 may also be indicated in response to actions other than those which require tilting operations.

FIG. 5 illustrates a modified embodiment of the time of tip-over indicator according to the present invention. The modified unit 30 is simpler in implementation and operation than the unit 1. The circuitry of the unit 30 includes a battery 31, a tilt switch 32 such as a mercury switch, and a fairly conventional clock/calender/display module 33. The clock module 33 maintains a time count and contemporaneously updates a display portion to show the current time, in the manner of a conventional digital clock or watch. Indicia representing the time of day may be alternated with indicia representing the month and date. The battery 31 provides operating power to the clock module 33 through the tilt switch 32 when closed.

When a structure to which the unit 30 is attached is tilted, the tilt switch 32 is opened, thereby shutting down the clock module 33, and thereafter closed, thereby restarting the clock module 33. Whenever the clock module 33 is restarted, it resets to a given time and date, such as twelve o'clock midnight on January 1, and begins updating the display portion therefrom. In the unit 30, this mode of operation can be used to indicate the elapsed time since the structure 2 was last tilted. In the case of a refuse container emptied by tilting, this can indicate when the container was last emptied by subtracting the amount of time represented by the displayed from the current time of day. While the time of tip-over indicator unit 30 is does not display its time indication in quite as convenient a format as the unit 1 does, it is adequate for the purpose intended. The unit 30 may be enclosed in the same type of case 10 as the unit 1 and affixed to the structure 2 in the same manner as the unit 1 is.

It is to be understood that while certain forms of the present invention have been illustrated and described herein, it is not to be limited to the specific forms or arrangement of parts described and shown.

What is claimed and desired to be secured by Letters Patent is as follows:

1. In combination:

(a) a refuse container emptied by tilting:

(b) tilt switch means mounted on said container and changing a switch state upon said container being tilted;

(c) clock display means operative to display indicia representing a time of occurrence of an event; and (d) clock means having said switch means and said display means connected thereto and maintaining a current time, said clock means causing said display means to display indicia represent a current time of occurrence in response to said switch means changing said switch state upon said container being tilted to thereby indicate a time when said container was last emptied.

2. A time of tilt indicator apparatus for indicating a time of emptying a refuse container which is emptied by tilting, said apparatus comprising:

(a) a refuse container which is emptied by tilting same from a first orientation to a second orientation;

(b) tilt switch means positioned on said refuse container, said tilt switch means assuming a first switch state in said first orientation and a second switch state in said second orientation;

(c) clock means connected to said tilt switch means, said clock means generating a time count which is updated at regular time intervals and proportioning said time count to data representing hours and minutes of the current time of day;

(d) clock display means connected to said said clock means and operable to display numerals representing hours and minutes of a time of day; and (e) said clock means, said display means, and said tilt switch means cooperating in such a manner that, upon said container being tilted from said first orientation to said second orientation and back to said first orientation and said tilt switch means transitioning from said first switch state to said second switch state and back to said first switch state, said clock means causing the display of numerals on said display means representing the hours and minutes of the current time of day when said tilt switch means transitioned from said second switch state back to said first switch state and maintaining the display of said numerals until said container is subsequently tilted.

3. An apparatus as set forth in claim 2 wherein:

(a) said clock means is operative to proportion said time count to data representing the current month and date and causes the alternate display on said display means of numerals representing the month and date when said tilt switch means transitioned from said second switch state to said first switch state with said numerals representing said hours and minutes.

4. An apparatus as set forth in claim 2 wherein:

(a) said tilt switch means is a mercury switch.

5. An apparatus as set forth in claim 2 wherein said clock means includes:

(a) a microprocessor operating as said digital clock means by execution of a program which causes the performance of functions of said clock means.

6. An apparatus as set forth in claim 5 wherein:

(a) said microprocessor includes an interrupt terminal;

(b) said tilt switch means is connected to said interrupt terminal; and (c) said transition of said tilt switch means from said second switch state to said first switch state causes a change in an electrical condition at said interrupt terminal which causes said microprocessor t update said numerals displayed on said display means.

* * * * *